US008167681B2

(12) United States Patent
Oishi et al.

(10) Patent No.: US 8,167,681 B2
(45) Date of Patent: May 1, 2012

(54) SLICING METHOD

(75) Inventors: Hiroshi Oishi, Nishishirakawa (JP); Daisuke Nakamata, Chikuma (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 542 days.

(21) Appl. No.: 12/310,652

(22) PCT Filed: Aug. 22, 2007

(86) PCT No.: PCT/JP2007/066227

§ 371 (c)(1), (2), (4) Date: Mar. 3, 2009

(87) PCT Pub. No.: WO2008/035529

PCT Pub. Date: Mar. 27, 2008

(65) Prior Publication Data

US 2010/0037881 A1 Feb. 18, 2010

(30) Foreign Application Priority Data

Sep. 22, 2006 (JP) ..... 2006-257380

(51) Int. Cl.
*B24B 49/00* (2006.01)

(52) U.S. Cl. ..... 451/7; 125/16.03

(58) Field of Classification Search ..... 451/7, 53; 125/16.02

See application file for complete search history.

(56) References Cited

U.S. PATENT DOCUMENTS

| | | | | |
|---|---|---|---|---|
| 5,269,285 | A * | 12/1993 | Toyama et al. | 125/16.01 |
| 5,827,113 | A * | 10/1998 | Okuno et al. | 451/36 |
| 6,006,737 | A * | 12/1999 | Hayashi et al. | 125/16.02 |
| 6,652,356 | B1 * | 11/2003 | Ariga | 451/7 |
| 7,988,530 | B2 * | 8/2011 | Oishi et al. | 451/7 |
| 2002/0174861 | A1 * | 11/2002 | Lundt et al. | 125/21 |
| 2006/0249134 | A1 * | 11/2006 | Kawasaki et al. | 125/21 |
| 2007/0178807 | A1 * | 8/2007 | Gupta et al. | 451/5 |
| 2009/0253352 | A1 * | 10/2009 | Oishi et al. | 451/7 |
| 2010/0163010 | A1 * | 7/2010 | Kitagawa | 125/21 |

FOREIGN PATENT DOCUMENTS

| | | |
|---|---|---|
| JP | A-09-262826 | 10/1997 |
| JP | A-2006-150505 | 6/2006 |
| WO | WO 2005/039824 A1 | 5/2005 |

* cited by examiner

*Primary Examiner* — Maurina Rachuba

(57) ABSTRACT

The present invention provides a slicing method comprising winding a wire around a plurality of grooved rollers and pressing the wire against an ingot to be sliced into wafers while supplying a slurry for slicing to the grooved rollers and causing the wire to travel, wherein a supply temperature of the slurry for slicing is controlled, and slicing is performed in such a manner that the supply temperature of the slurry for slicing and a temperature of the ingot become at least 30° C. or above at end of slicing the ingot. As a result, there is provided the slicing method that can alleviate precipitous cooling of an ingot in the time close to end of slicing the ingot and thereby suppress production of a nano-topography when slicing the ingot by using a wire saw.

4 Claims, 13 Drawing Sheets

FIG. 6
(A)
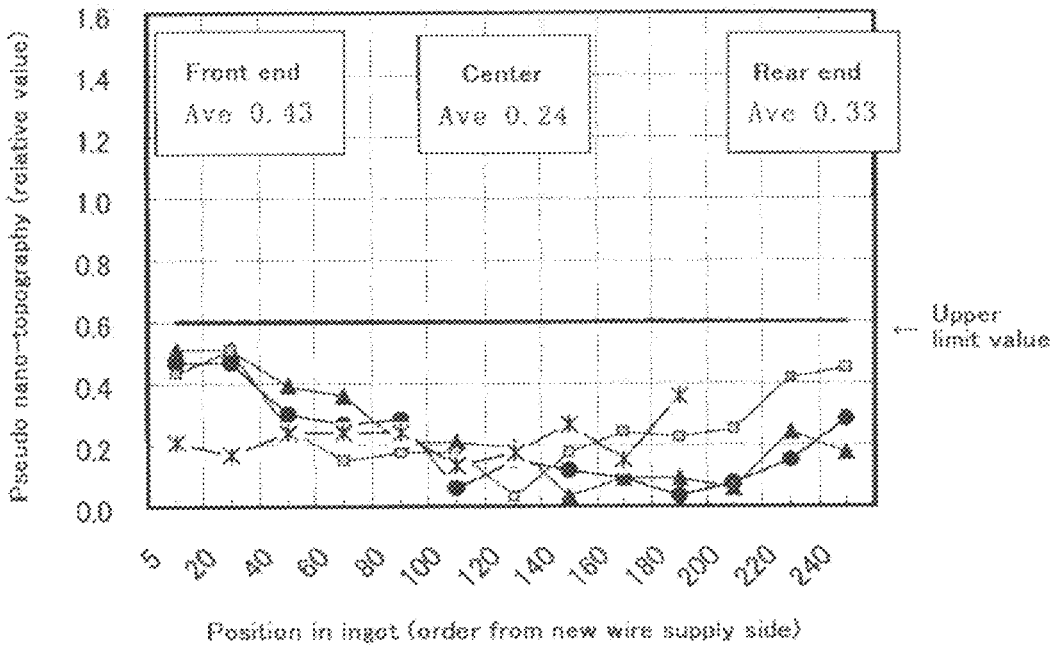
(B)
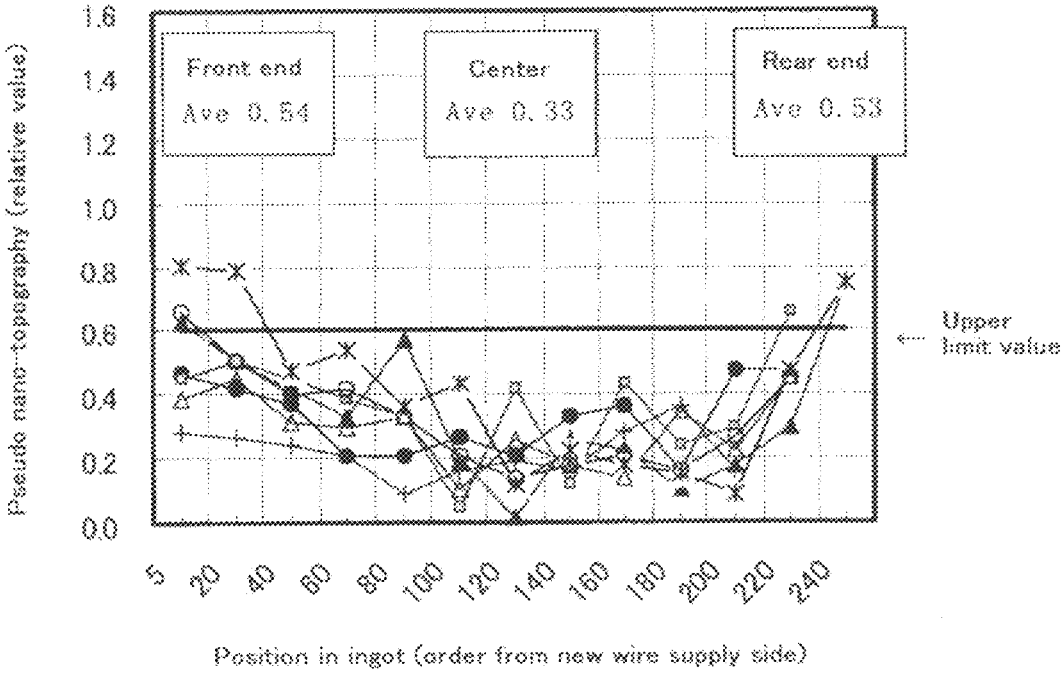

FIG. 10

| | | | |
|---|---|---|---|
| Conformation | Extemporaneous generation 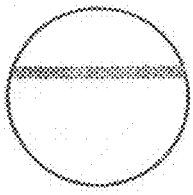 | Generation at slicing start/slicing end portion 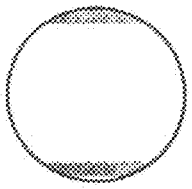 | Waviness having periodicity 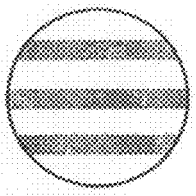 |
| Characteristics | | · High percentage of rejection in nano-topography numeric judgment | · Becoming problem in sensory test wholly |
| Cause | · Wire disconnection<br>· Origination from wire (lot defect)<br>· Control defect of wire saw apparatus | · Precipitous thermal expansion/contraction of work<br>· Sudden change in slicing resistance | · Work feed straightness defect |

FIG. 13
(A)
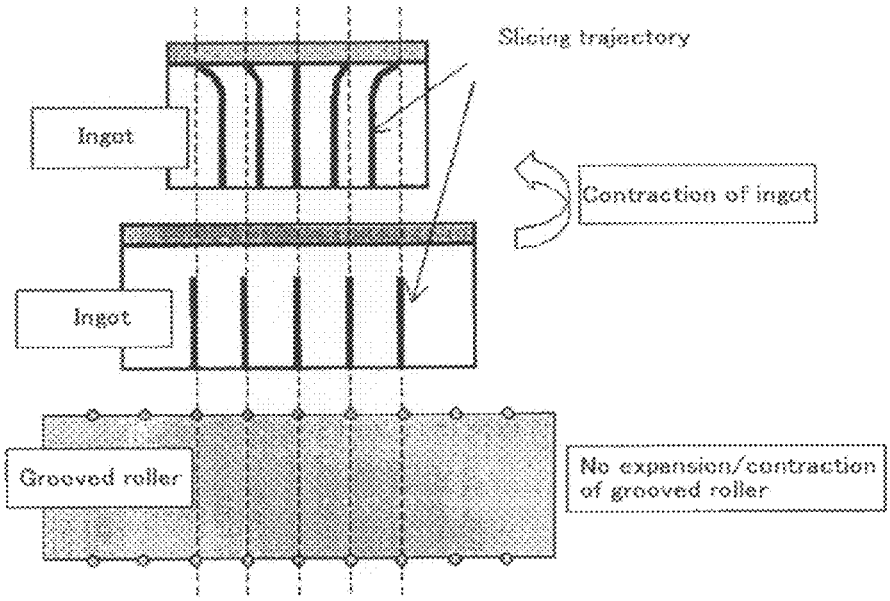
(B)
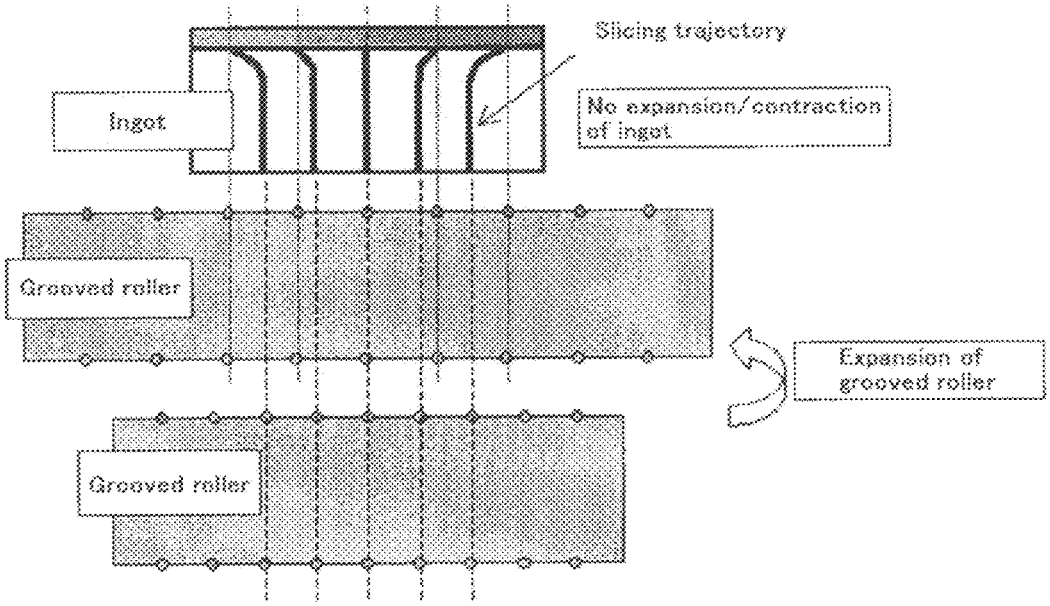

FIG. 14
(A)
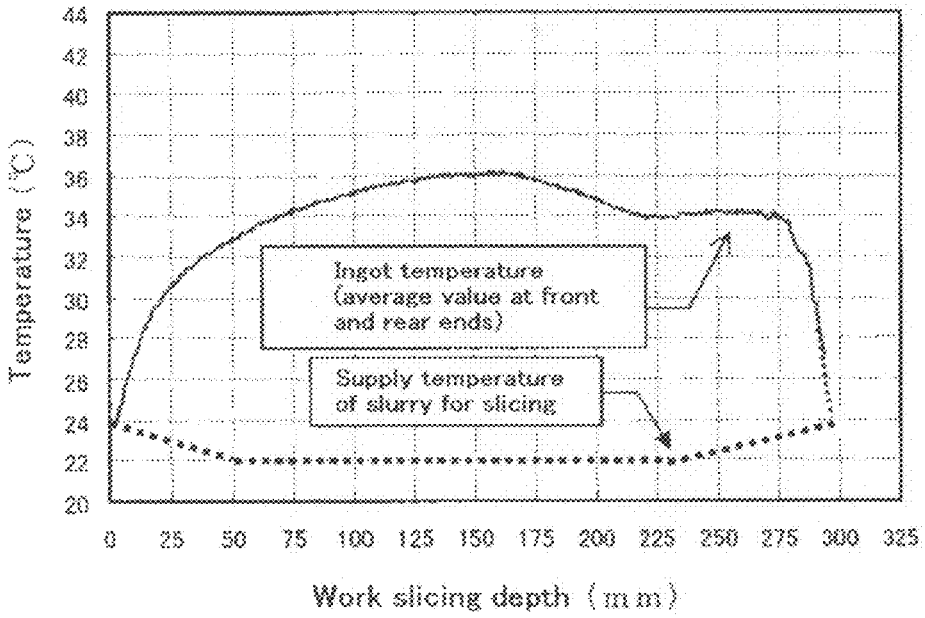
(B)
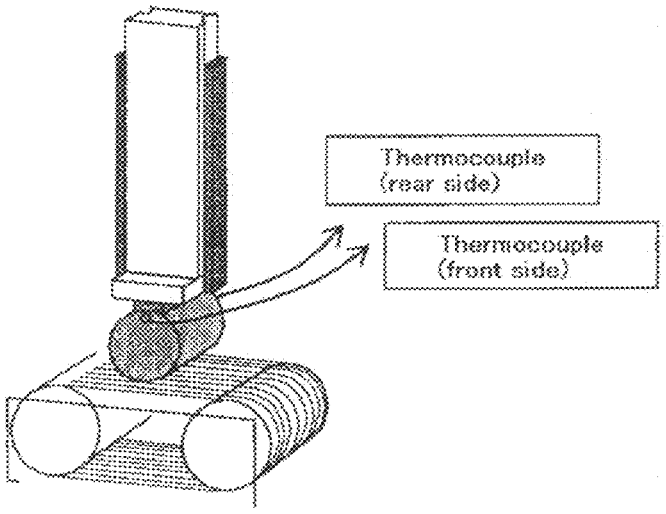

FIG. 15
(A)
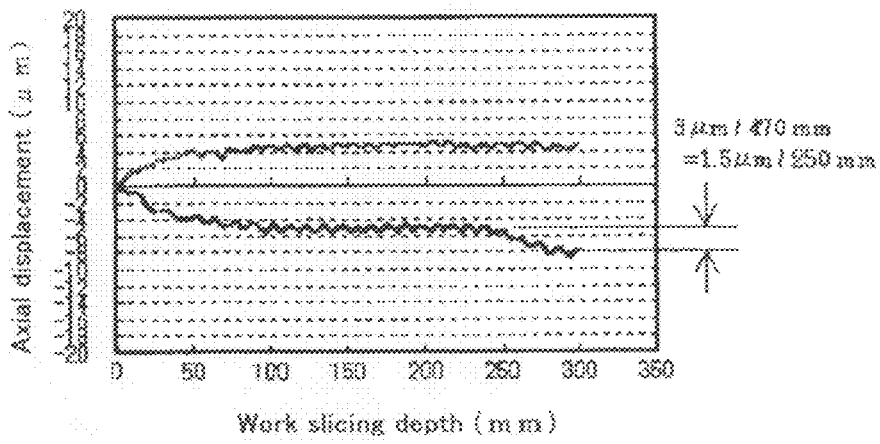
(B)
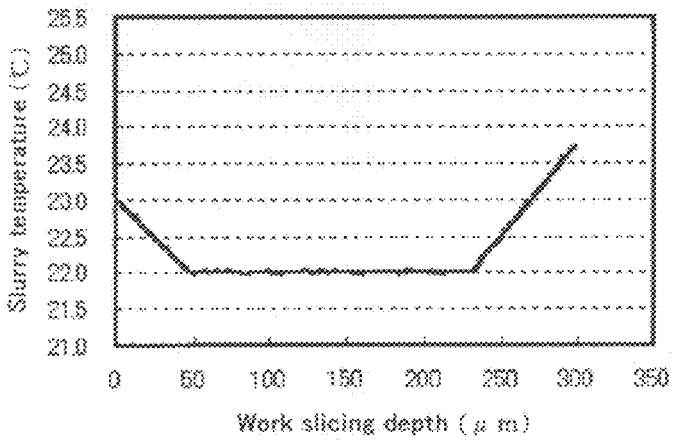
(C)
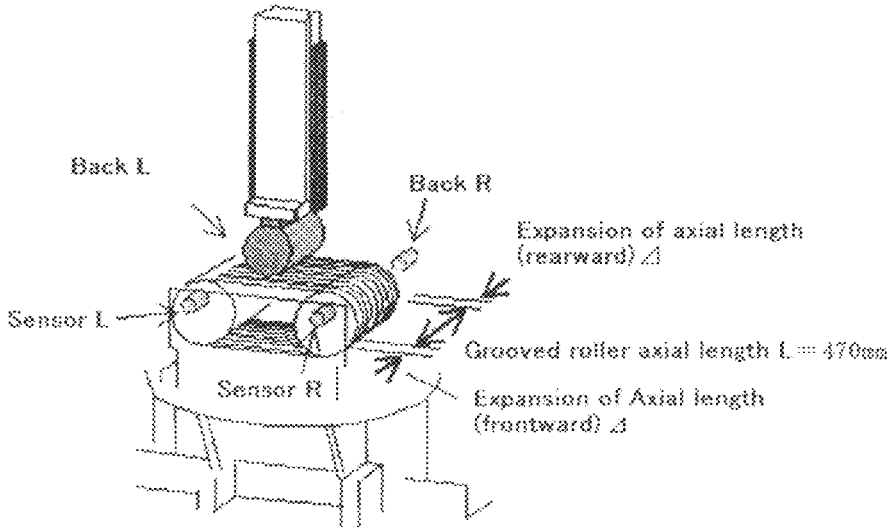

FIG. 16
(A)
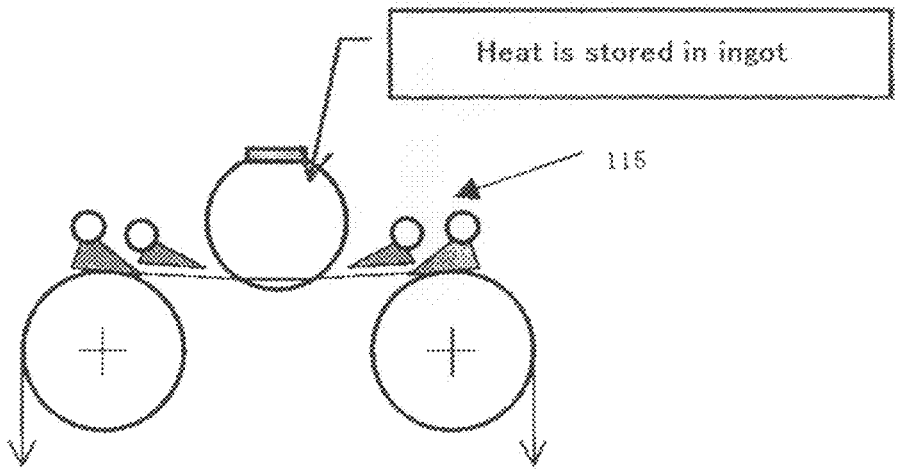
(B)
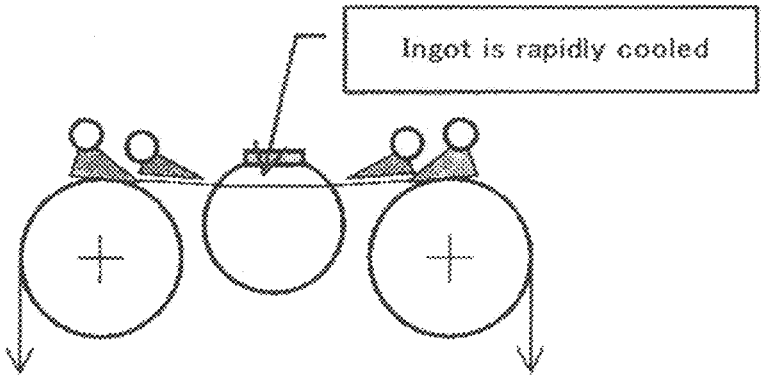

SLICING METHOD

TECHNICAL FIELD

The present invention relates to a slicing method for slicing, e.g., a silicon ingot or an ingot of a compound semiconductor into many wafers by using a wire saw.

BACKGROUND ART

In recent years, an increase in size of a wafer is demanded, and a wire saw is mainly used to slice an ingot with this increase in size.

The wire saw is a apparatus that allows a wire (a high-tensile steel wire) to travel at a high speed and presses an ingot (a work) against the wire to be sliced while applying a slurry to the wire, thereby slicing the ingot into many wafers at the same time (see Japanese Unexamined Patent Publication (Kokai) No. 262826-1997).

Here, FIG. 8 shows an outline of an example of a general wire saw.

As shown in FIG. 8, a wire saw 101 mainly includes a wire 102 that slices an ingot, grooved rollers 103 (wire guides) around which the wire 102 is wound, a mechanism 104 that gives the wire 102 a tensile force, a mechanism 105 that feeds the ingot to be sliced, and a mechanism 106 that supplies a slurry at the time of slicing.

The wire 102 is unreeled from one wire reel 107 and reaches the grooved rollers 103 through the tensile-force-giving mechanism 104 formed of a powder clutch (a constant torque motor 109), a dancer roller (a dead weight) (not shown) and so on through a traverser 108. The wire 102 is wound around this grooved rollers 103 for approximately 300 to 400 turns, and then taken up by a wire reel 107' through the other tensile-force-giving mechanism 104'.

Further, the grooved roller 103 is a roller that has a polyurethane resin press-fitted around a steel cylinder and has grooves formed at a fixed pitch on a surface thereof, and the wire 102 wound therearound can be driven in a reciprocating direction in a predetermined cycle by a driving motor 110.

It is to be noted that such an ingot-feeding mechanism 105 as shown in FIG. 9 feeds the ingot to the wire 102 wound around the grooved rollers 103 at the time of slicing the ingot. This ingot-feeding mechanism 105 includes an ingot-feeding table 111 that is used to feed the ingot, an LM guide 112, an ingot clump 113 for grasping the ingot, a slice pad plate 114, and others, and driving the ingot-feeding table 111 along the LM guide 112 under control of a computer enables feeding the ingot fixed at the end at a previously programmed feed speed.

Moreover, nozzles 115 are provided near the grooved rollers 103 and the wound wire 102, and a slurry can be supplied to the grooved rollers 103 and the wire 102 from a slurry tank 116 at the time of slicing. Additionally, a slurry chiller 117 is connected with the slurry tank 116 so that a temperature of the slurry to be supplied can be adjusted.

Such a wire saw 101 is used to apply an appropriate tensile force to the wire 102 from the wire-tensile-force-giving mechanism 104, and the ingot is sliced while causing the wire 102 to travel in the reciprocating direction by the driving motor 110.

On the other hand, in a wafer, a size of a surface waviness component that is called "nano-topography" is a problem in recent years. This nano-topography is obtained by taking a wavelength component having a wavelength $\lambda$=0.2 mm to 20 mm that is shorter than "Sori" or "Warp" and longer than "surface roughness" out of a surface shape of a wafer. And, this nano-topography is very shallow waviness having a PV value of 0.1 μm to 0.2 μm or below. It is said that this nano-topography affects a yield of an STI (Shallow Trench Isolation) process in device manufacture.

Although the nano-topography is produced in a wafer processing step (slicing to polishing), it was revealed that a nano-topography caused due to wire saw slicing (i.e., slice waviness) can be classified into three types, i.e., "one that is extemporaneously produced", "one that is produced in a position where slicing is started or ended", and "one having a periodicity" as shown in FIG. 10.

Of these types, one that is produced in "slicing start/end portion of a wafer" has a high rate that it is rejected in a numeric judgment regarding a nano-topography. In particular, a nano-topography in the "slicing end portion" has a higher rate than a nano-topography in the "slicing start portion". And the "slicing end portion" highly frequently becomes a position making a numeric value regarding a nano-topography the worst in a wafer radial direction or the nano-topography in the "slicing end portion" is rejected in the numeric judgment, and hence improvement is strongly demanded.

DISCLOSURE OF INVENTION

Thus, the present inventors examined nano-topographies in sliced wafers sliced by using such a conventional wire saw as shown in FIG. 8.

FIG. 11 shows Warp cross-sectional shapes measured by an electric capacitance type measuring instrument and "pseudo nano-topographies" of the sliced wafers. The pseudo nano-topography means obtaining a numeric value having a correlation with a nano-topography of a polished wafer in a pseudo manner by applying a band-pass filter having simulated processing characteristics of lapping, grinding, and polishing with respect to Warp cross-sectional wave shape of the sliced wafer.

In general, the nano-topography is measured after polishing but, when a pseudo nano-topography is obtained from the sliced wafer and the obtained pseudo nano-topography is used, a cost and a time do not have to be increased, and a nano-topography caused due to an influence of slicing alone can be readily examined without being affected by a factor in a process such as polishing after slicing.

It was understood from such an examination that a nano-topography near a slicing end portion that is demanded to be improved the most in the conventional technology is caused due to a precipitous change in a Warp shape of a wafer in this position.

FIG. 11(A) shows a wafer holding small change in shape in a position near a slicing end portion as depicted in a shape map, and a size of a change of a pseudo nano-topography is suppressed to the range of ±0.1 μm and relatively small in the position near the slicing end portion as can be understood from the pseudo nano-topography. On the other hand, as shown in FIG. 11(B) or FIG. 11(C), it can be understood that, when a shape in the position near the slicing end portion is precipitously changed, a size of a pseudo nano-topography falls within the range of −0.3 to 0.4 in this position and is larger than that depicted in FIG. 11(A).

It is to be noted that, if a change in the entire shape is gentle even though this change is slightly large, the nano-topography is hardly produced. A precipitous change in shape greatly affects the nano-topography.

Thus, a factor of generation of such a precipitous change in a sliced wafer in the position near the slicing end portion as shown in FIG. 11 was examined.

First, FIG. 12 shows an example of a change in shape of a sliced wafer, i.e., a slicing trajectory of the wire at the time of ingot slicing. As shown in FIG. 12, a trajectory of the wire greatly spreads on the outer side in slicing end portions near both ends of an ingot in particular, whereby a Warp cross-sectional shape of the sliced wafer is precipitously changed.

As a possibility of occurrence of such a cross-sectional shape (a slicing trajectory), the following two hypotheses can be considered.

One is a case where a slicing trajectory formed by the wire is bent toward an end of the ingot when the ingot is contracted in an axial direction thereof in a time close to end of slicing as shown in FIG. 13(A), and the other is a case where the slicing trajectory is bent when the grooved rollers having the wire that slices the ingot wound therearound are expanded in an axial direction thereof as shown in FIG. 13(B).

The present inventors conducted a test and examined an influence of each of these possibilities on the slicing trajectory.

A possibility that the ingot is contracted in the axial direction as shown in FIG. 13(A) was first examined.

Such a wire saw as depicted in FIG. 8 was used to slice a silicon ingot having a diameter of 300 mm and a length of 250 mm prepared for the test. A tensile force of 2.5 kgf was applied to the wire, and the wire was caused to travel in a reciprocating direction at an average speed of 500 m/min in a cycle of 60 s/c to perform slicing. Further, a supply temperature of a slurry for slicing had a temperature profile depicted in FIG. 14(A). It is to be noted that a temperature was measured at both ends (positions having a slicing depth of 285 mm) of the ingot by using a thermocouple (see FIG. 14(B)).

FIG. 14(A) shows a result obtained by measuring a change in temperature of the ingot during a slicing process.

A temperature of the ingot was increased by 13° C. to become approximately 36° C. at maximum during the slicing process, and it was precipitously reduced approximately 10° C. near a slicing end portion (a slicing depth of 275 mm to 300 mm in this example). This coincides with a position where the Warp shape suddenly changes near the slicing end portion. Additionally, it can be understood from calculation using a thermal expansion coefficient that the ingot is precipitously contracted approximately 10 μm in the axial direction near the slicing end position.

It can be considered that this contraction occurs because a temperature of the ingot is rapidly reduced to the same temperature as that of the slurry for slicing when a slicing load is reduced to ½ or below of a maximum value or when the ingot moves down with advancement of slicing and the slurry for slicing cooled to 22° C. to 24° C. is directly applied to the ingot, for example.

It is to be noted that the temperature of the ingot, which was once decreased, is again increased at a slicing depth 200 mm or a further depth in FIG. 14(A) because a flow quantity of the slurry is reduced here.

A possibility that the grooved rollers are expanded in the axial direction thereof as shown in FIG. 13(B) was examined.

The same silicon ingot was sliced under the same slicing conditions as those of the above-explained test except a supply temperature of a slurry, and expansion of the grooved roller in the axial direction was measured (see FIG. 15(A)). It is to be noted that a supply temperature of a slurry for slicing had a temperature profile depicted in FIG. 15(B).

Further, expansion of the grooved roller in the axial direction was measured by arranging an eddy current sensor in close proximity to the axial direction of the grooved roller (see FIG. 15(C)).

As shown in FIG. 15(A), the grooved roller was gently expanded in a major part, but a front side of the grooved roller had a relatively high expansion rate near a slicing end portion (it is to be noted that an upper line in FIG. 15(A) indicates an amount of rearward expansion of the grooved roller depicted in FIG. 15(C) and a lower line indicates an amount of frontward expansion of the same). However, in the current test, an expansion amount at this portion (regarding approximately 250 mm corresponding to an ingot length) was as relatively small as approximately 1 mm to 2 mm, and it was revealed that an influence on a slicing trajectory is small. It can be considered that temperature adjustment for a grooved roller core grid, a main spindle, and a bracket efficiently functions in an apparatus utilized in the current test.

With the above-explained circumstances, it can be considered that a primary factor of a sudden change in slicing trajectory near the slicing end portion that is a problem, i.e., a sudden change in Warp shape in the sliced wafer is contraction of the ingot in the axial direction depicted in FIG. 13(A).

As explained above, the slurry for slicing is rarely directly applied to the ingot and the ingot is hard to be cooled from start of slicing to a middle stage of slicing, and processing heat is stored in the ingot (see FIG. 16(A)). As a result, a temperature of the ingot is increased 13° C. at maximum. Thermal expansion of the ingot involved by this temperature increase is approximately 10 μm in calculation (with respect to the ingot having a length of 250 mm). On the other hand, near the slicing end portion, as shown in FIG. 16(B), the slurry is directly applied to the ingot to reduce a temperature of the ingot and a slicing load is decreased to ½, and the temperature of the ingot is precipitously reduced by 10° C. As a result, the work is thermally contracted, which is a factor of a sudden change in Warp shape. As shown in FIG. 13(A), an influence of this thermal expansion/thermal contraction becomes large when the ingot has a longer length or when getting closer to both ends of the ingot.

Therefore, in view of the above-explained problems, it is an object of the present invention to provide a slicing method for alleviating precipitous cooling of an ingot in a time close to end of slicing of the ingot and consequently suppressing generation of a nano-topography when slicing the ingot by using a wire saw.

To achieve this object, the present invention provides a slicing method comprising winding a wire around a plurality of grooved rollers and pressing the wire against an ingot to be sliced into wafers while supplying a slurry for slicing to the grooved rollers and causing the wire to travel, wherein a supply temperature of the slurry for slicing is controlled, and slicing is performed in such a manner that the supply temperature of the slurry for slicing and a temperature of the ingot become at least 30° C. or above at end of slicing the ingot.

As explained above, according to the slicing method of the present invention, since a supply temperature of the slurry for slicing is controlled and at least the supply temperature of the slurry for slicing and a temperature of the ingot are set to 30° C. or above at end of slicing the ingot to perform slicing, the temperature of the ingot at end of slicing does not have to be reduced as compared with a conventional slicing method.

In the conventional slicing method, a temperature of the slurry for slicing at end of slicing is a room temperature (approximately 22° C. to 25° C.) which is a relatively low temperature, and hence a temperature of the ingot during slicing is also rapidly reduced to approximately the room temperature in a time close to end of slicing.

However, in the present invention, since the supply temperature of the slurry for slicing at end of slicing is also controlled to 30° C. or above, the temperature of the ingot at end of slicing can be also set to 30° C. or above, i.e., a change in temperature of the ingot in the time close to end of slicing can be reduced, thus alleviating rapid cooling. As a result, occurrence of a precipitous change in slicing trajectory or Warp shape can be suppressed, and a nano-topography can be improved.

At this time, it is possible that a supply temperature of the slurry for slicing is set to be higher than a temperature of the ingot at start of slicing the ingot, then increased from the moment that a slicing depth of the ingot reaches at least ⅔ of a diameter, and raised to 30° C. or above at end of slicing the ingot.

Alternatively, it is possible that a supply temperature of the slurry for slicing is set to be equal to a temperature of the ingot or below at start of slicing the ingot, then increased from the moment that a slicing depth of the ingot reaches at least ⅔ of a diameter, and raised to 30° C. or above at end of slicing the ingot.

Controlling a supply temperature of the slurry for slicing with such temperature profiles enables further assuredly setting the supply temperature of the slurry for slicing and a temperature of the ingot at end of slicing to 30° C. or above.

Moreover, it is preferable that a difference between a maximum temperature of the ingot during slicing and a temperature of the same at end of slicing is set to 5° C. or below.

When a difference between the maximum temperature of the ingot during slicing and the temperature of the same at end of slicing is set to 5° C. or below, a change in temperature of the ingot can be reduced, and a degree of rapid cooling at end of slicing can be decreased. Therefore, a slicing trajectory can be further effectively prevented from greatly varying, and a level of a nano-topography can be further suppressed.

According to the slicing method of the present invention, rapid cooling of the ingot can be reduced in a time close to end of slicing, and a high-quality wafer having a nano-topography effectively suppressed therein can be obtained.

BRIEF DESCRIPTION OF DRAWINGS

FIG. 6 are graphs showing levels of pseudo nano-topographies, wherein FIG. 6(A) shows a result of Example 1 and FIG. 6(B) shows a result of Comparative Example;

FIG. 10 is an explanatory view showing classification of nano-topographies produced due to wire saw slicing;

FIG. 13(A) is an explanatory view showing an example of contraction of an ingot and slicing trajectories at the time of slicing the ingot, and FIG. 13(B) is an explanatory view showing an example of expansion of a grooved roller and slicing trajectories at the time of slicing the ingot;

FIG. 14 show a test result about a possibility of contraction of the ingot in an axial direction, wherein FIG. 14(A) is a graph showing a temperature change of the ingot during slicing and a supply temperature profile of a slurry for slicing and FIG. 14(B) is an explanatory view for explaining a measurement method for a temperature of the ingot;

FIG. 15 show a test result about a possibility of expansion of the grooved roller in an axial direction, wherein FIG. 15(A) is a graph showing an expansion change of the grooved roller during slicing, FIG. 15(B) is a graph showing a supply temperature profile of the slurry for slicing, and FIG. 15(C) is an explanatory view for explaining a measurement method for an expansion and contraction amount of the grooved rollers; and FIG. 16 are explanatory views for explaining a process that the ingot is rapidly cooled, wherein FIG. 16(A) shows the time of starting slicing and FIG. 16(B) shows a position near a slicing end portion.

BEST MODE(S) FOR CARRYING OUT THE INVENTION

Although an embodiment according to the present invention will be explained hereinafter, but the present invention is not restricted thereto.

Figure 8:
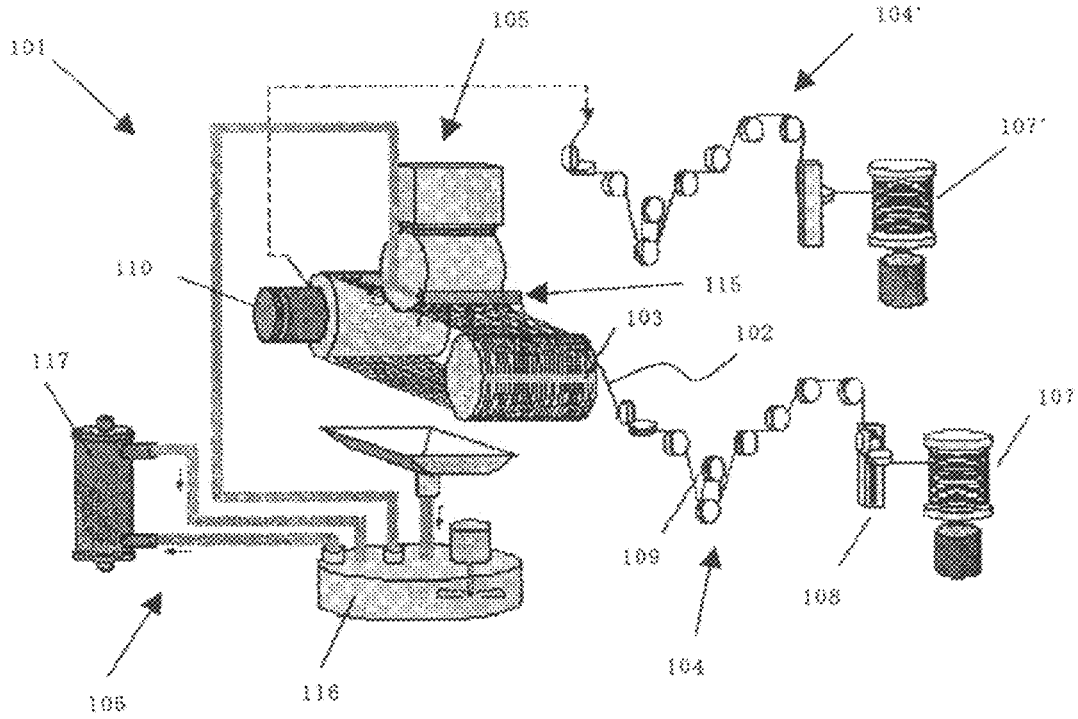
FIG. 8 is a schematic view showing an example of a wire saw used in a conventional slicing method.
Figure 9:
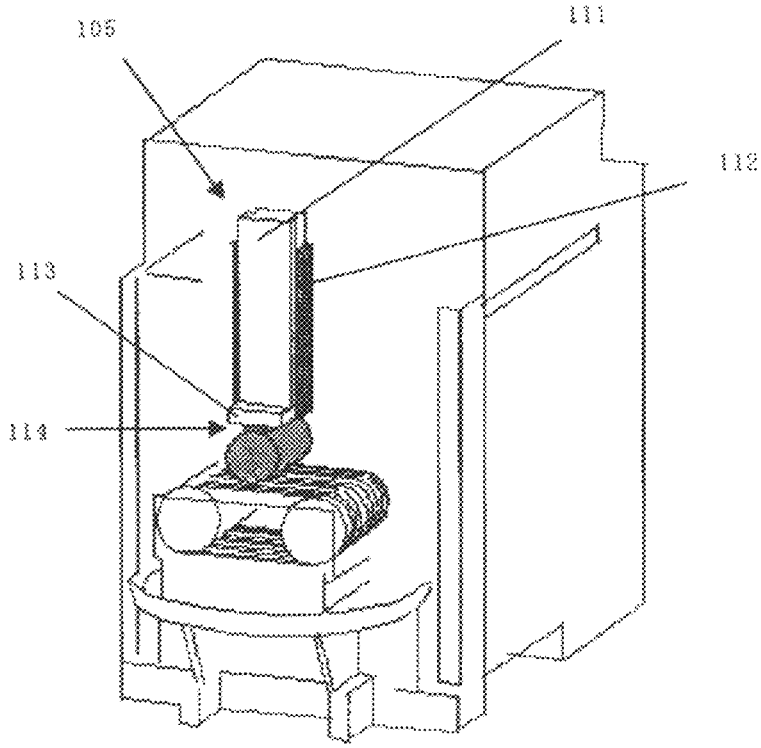
FIG. 9 is a schematic view showing an example of an ingot-feeding mechanism.
Figure 11:
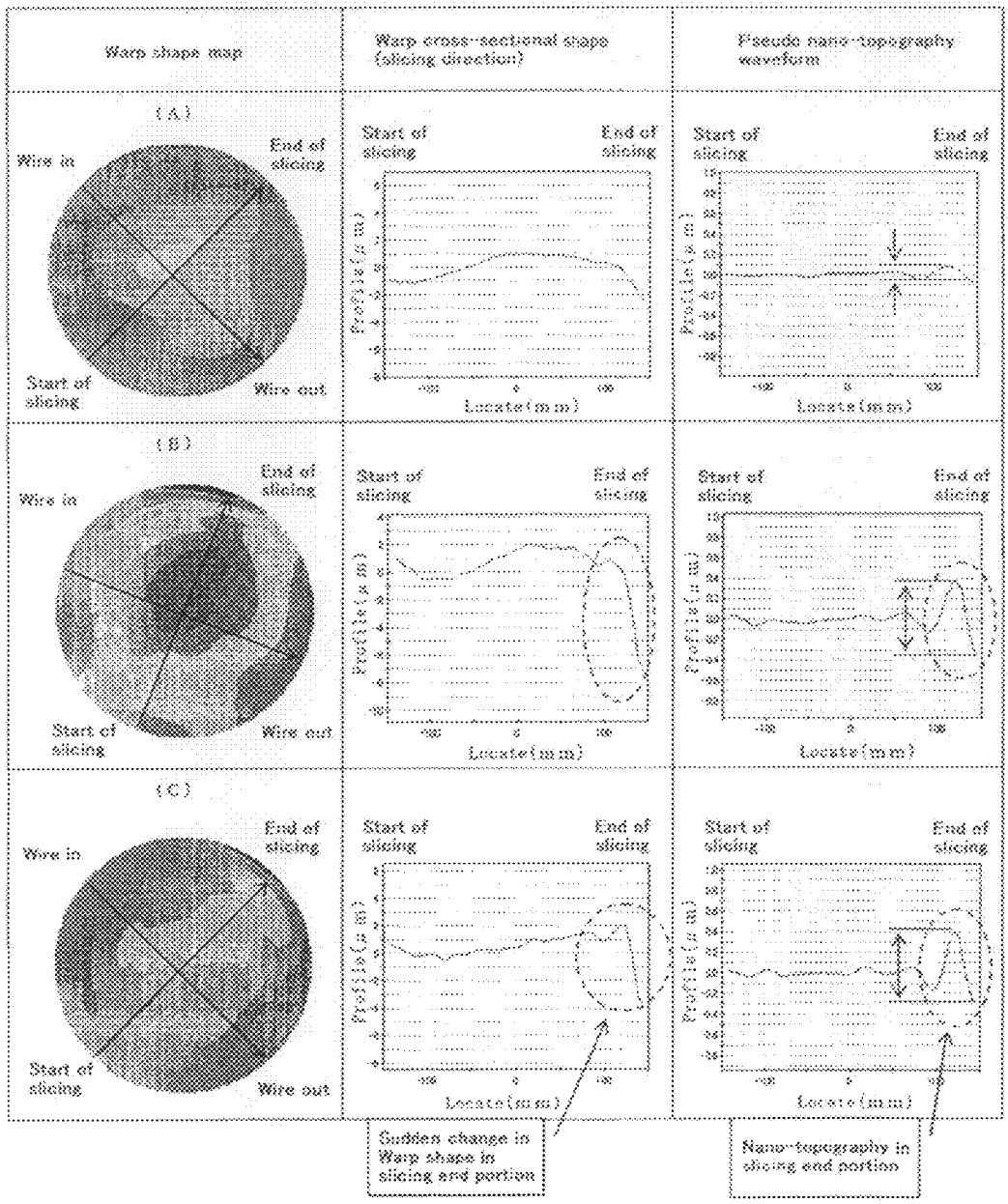
FIG. 11 is a measurement view showing Warp cross-sectional shapes and pseudo nano-topographies of sliced wafers.
Figure 12:
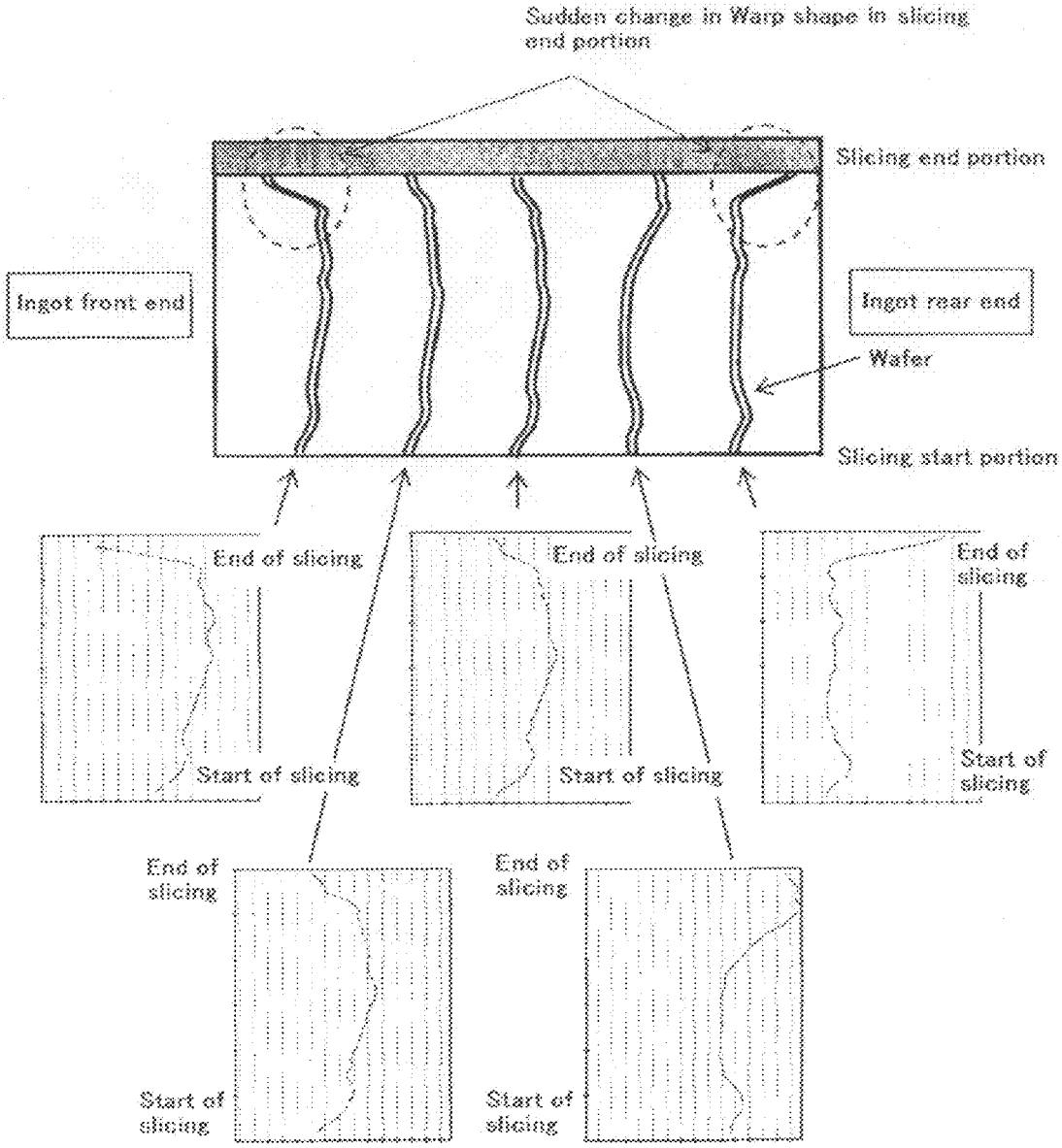
FIG. 12 is a schematic view showing an example of slicing trajectories of the wire at the time of slicing the ingot.

For example, when such a wire saw as shown in FIG. 8 is used to slice an ingot into wafers, in the obtained sliced wafers, such a precipitous change in shape as shown in FIG. 11(B) or FIG. 11(C) is observed near a slicing end portion, and it is revealed that a nano-topography on a large level is produced at a corresponding position.

As explained above, as a major factor of this precipitous change in shape, it can be considered that the ingot is rapidly cooled and contracted in the time close to end of slicing and a slicing trajectory is precipitously bent.

As explained above, as a result of studies about rapid cooling of the ingot in a time close to end of slicing repeatedly keenly conducted by the present inventors, a slicing load is reduced to ½ in a position near a slicing end portion, a position of the ingot is relatively lowered, and a slurry for slicing sprayed toward a wire or grooved rollers is directly applied. This slurry for slicing usually has a temperature that is approximately a room temperature (22° C. to 25° C.) in a conventional technology, the ingot which is in the slicing process and has a temperature of, e.g., approximately 35° C. is rapidly cooled when, e.g., this slurry for slicing is directly applied thereto, whereby the ingot has nearly the same temperature close to the room temperature as a supply temperature of the slurry for slicing.

Thus, the present inventors discovered that setting a supply temperature of this slurry for slicing and a temperature of the ingot to 30° C. or above at the end of slicing, i.e., setting the supply temperature of the slurry for slicing to 30° C. or above at the end of slicing enables making it hard to reduce the temperature of the ingot even if the slurry for slicing is applied to the ingot and setting the temperature of the ingot to 30° C. or above. As a result, the present inventors discovered that the temperature of the ingot can be suppressed from being suddenly reduced, a slicing trajectory can be prevented from precipitously varying, and a nano-topography can be considerably improved, thereby the present invention has been brought to completion.

A slicing method using a wire saw according to the present invention will now be explained in detail hereinafter with reference to the drawings, but the present invention is not restricted thereto.

Figure 1:
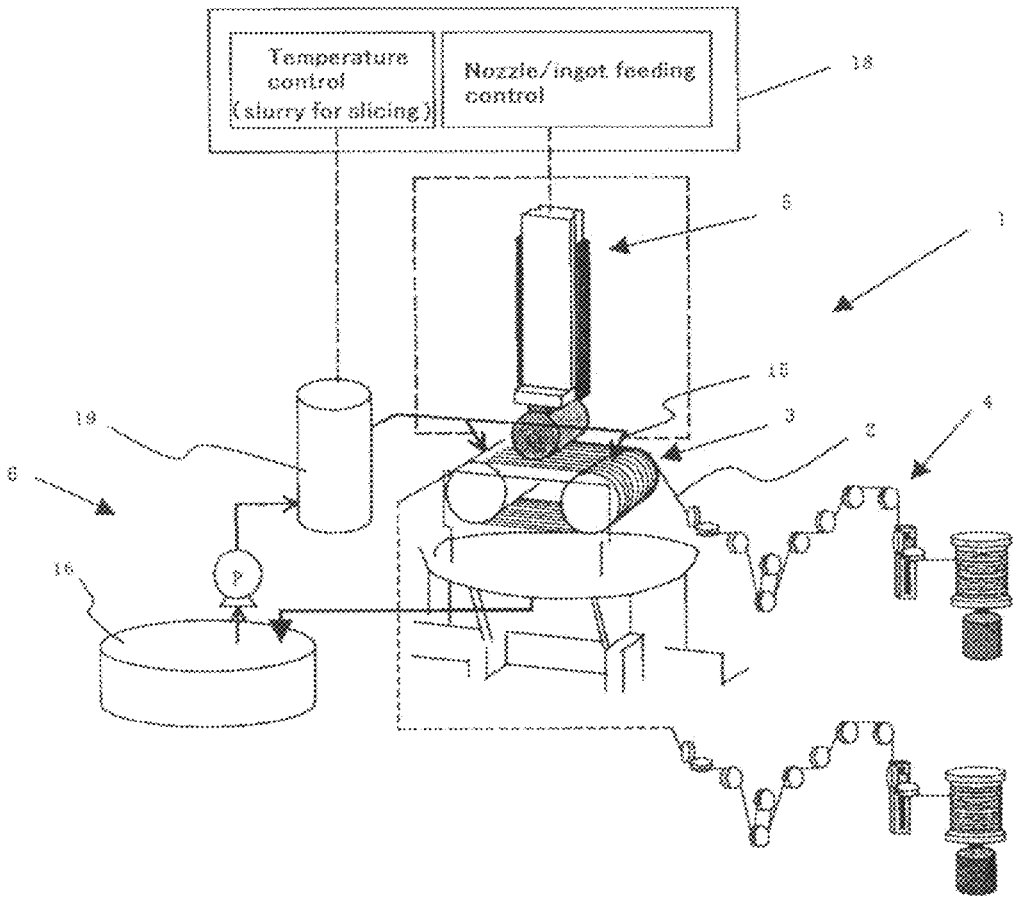
FIG. 1 is a schematic view showing an example of a wire saw that can be used in a slicing method according to the present invention.

FIG. 1 shows an example of a wire saw that can be used for the slicing method according to the present invention.

As shown in FIG. 1, a wire saw 1 mainly includes a wire 2 to slice an ingot, grooved rollers 3, wire-tensile-force-giving mechanisms 4, and an ingot-feeding mechanism 5, and a slurry-supplying mechanism 6.

Here, the slurry supplying mechanism 6 will be first explained. As this slurry-supplying mechanism 6, nozzles 15 that supply a slurry for slicing to the grooved rollers 3 (the wire 2) is arranged. Further, a supply temperature of the slurry for slicing supplied from these nozzles 15 can be controlled. Specifically, for example, as shown in FIG. 1, the supply temperature of the slurry for slicing can be controlled by connecting a slurry tank 16 to the nozzles 15 through a heat exchanger 19 controlled by a computer 18.

Furthermore, a type of the slurry is not restricted in particular, and the same type as that in the conventional example can be used. For example, a slurry obtained by dispersing GC (silicon carbide) abrasive grains in a liquid can be used.

Moreover, the nozzles 15 that supply the slurry for slicing and the ingot-feeding mechanism 5 are connected with the computer 18, and a predetermined amount of the slurry for slicing can be automatically sprayed from the nozzles 15 to the grooved rollers 3 (the wire 2) at a predetermined timing with respect to a predetermined ingot-feeding amount, i.e., a predetermined ingot-slicing amount by using a preset program.

Although the ingot-feeding amount, the slurry-spraying amount and timing, and a supply temperature of the slurry can be controlled in a desired manner by the computer 18, controlling means is not restricted thereto in particular.

Furthermore, the wire 2, the grooved rollers 3, the wire-tensile-force-giving mechanisms 4, and the ingot-feeding mechanism 5 except the slurry-supplying mechanism 6 can be the same as those in the wire saw 101 used in the conventional slicing method depicted in FIG. 8.

A type and a thickness of the wire 2, a groove pitch of the grooved roller 3, a structure in any other mechanism, and others are not restricted in particular, and they can be determined each time so that desired slicing conditions can be obtained in accordance with the conventional method.

For example, the wire 2 can be formed of, e.g., a special piano wire having a width of approximately 0.13 mm to 0.18 mm, and the grooved roller 3 having a groove pitch of (a desired wafer thickness+a slicing removal) can be adopted.

A procedure of carrying out the slicing method according to the present invention by using such a wire saw 1 will now be explained hereinafter.

First, the ingot-feeding mechanism 5 is used to feed a grasped ingot toward a lower position at a predetermined speed, and the grooved rollers 3 are driven, thereby causing the wire 2 to which a tensile force is given by the wire-tensile-force-giving mechanisms 4 to travel in a reciprocating direction. It is to be noted that a magnitude of the tensile force given to the wire 2, a traveling speed of the wire 2, and others at this time can be appropriately set. For example, a tensile force of 2.5 kgf to 3.0 kgf can be applied to cause the wire 2 to travel in the reciprocating direction at an average speed of 400 m/min to 600 m/min in a cycle of 1 c/min to 2 c/min (30 s/c to 60 s/c). These values can be determined in accordance with, e.g., the ingot to be sliced.

Furthermore, the nozzles 15 are used to start spraying the slurry for slicing toward the grooved roller 3 and the wire 2, thereby the ingot is sliced.

A supply temperature profile of the slurry for slicing will now be explained.

In the conventional slicing method, as shown in FIG. 14(A), supply of the slurry for slicing is started at, e.g., 24° C., a temperature of the slurry for slicing is reduced to be held at a relatively low temperature (22° C.), and then the temperature is gradually increased toward the end of slicing so that the temperature becomes 24° C. at end of slicing which is equal to that at start of slicing.

In this manner, the supply temperature profile of the slurry for slicing in the conventional method usually varies only in the range of approximately 22° C. to 25° C. that is nearly a room temperature, and the temperature at end of slicing of course remains at a relatively low temperature that is approximately a room temperature.

Therefore, as explained above, when a slicing load is reduced and when the ingot is relatively fed toward the lower side and the slurry for slicing having a low temperature close to a room temperature is directly applied to the ingot as slicing gets closer to the end, a temperature of the ingot to be sliced is precipitously greatly lowered.

On the other hand, the present invention controls to provide such a temperature profile that a supply temperature of the slurry for slicing is set to 30° C. or above at the end of slicing.

Figure 2:
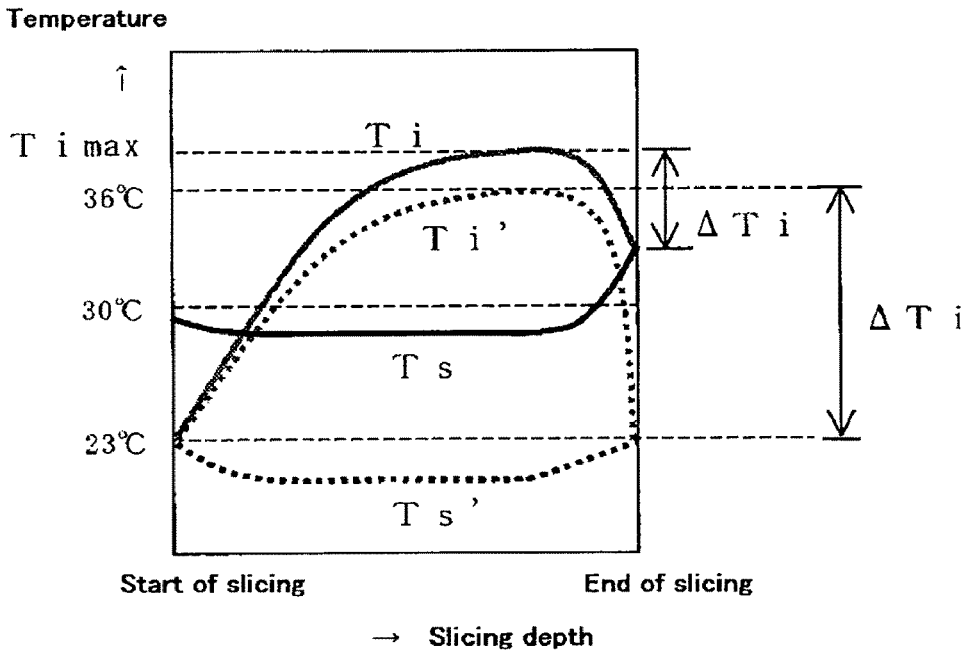
FIG. 2 is a graph showing an example of temperature profiles of a supply temperature of a slurry for slicing and a temperature of an ingot in the slicing method according to the present invention.

Giving a more specific description, for example, there is such a pattern as shown in FIG. 2.

Here, solid lines Ts and Ti in FIG. 2 represent a supply temperature profile of the slurry for slicing and a temperature profile of the ingot in the slicing method according to the present invention, and dotted lines Ts' and Ti' represent a supply temperature profile of the slurry for slicing and a temperature profile of the ingot in a conventional slicing method.

In the temperature profile Ts depicted in FIG. 2, a supply temperature of the slurry for slicing when starting slicing the ingot is a temperature higher than a temperature of the ingot (23° C. in this example), the supply temperature is slightly reduced after start of slicing, and then a constant temperature is continuously maintained. Further, as shown in, e.g., FIG. 11, a sudden change in ingot temperature (a sudden change in Warp cross-sectional shape) at the end of slicing starts when a slicing depth is approximately 240 mm/300 mm, and the supply temperature of the slurry for slicing is further increased beyond the maintained temperature to reach 30° C. or above at the end of slicing before this slicing depth, i.e., when the slicing depth of the ingot reaches at least ⅔ of a diameter so that the slicing load is reduced to approximately ½ or the slurry for slicing sprayed to the grooved rollers 3 or the wire 2 is directly widely applied to the ingot. Moreover, an effect can be likewise obtained when increasing the supply temperature is started from a slicing depth of 275 mm/300 mm or above where rapid cooing of the ingot actually occurs and the supply temperature reaches 30° C. at the end of slicing.

It can be understood that such a method of controlling the supply temperature of the slurry for slicing is a pattern controlled in such a manner that the supply temperature profile Ts' of the slurry for slicing in the conventional example is substantially uniformly increased over the entire range of slicing and reaches 30° C. or above at the end of slicing.

Further, when the supply temperature profile of the slurry for slicing is, e.g., such a temperature profile as represented by Ts, a temperature of the ingot to be sliced can have the temperature profile represented by Ti. According to the temperature profile Ti of the ingot in the slicing method of the present invention, it can be understood that rapid cooling of the ingot that occurs in the time close to end of slicing can be alleviated as compared with the temperature profile Ti' of the ingot in the conventional method.

That is because the ingot whose temperature has been increased to, e.g., approximately 36° C. during slicing can be set to 30° C. or above even though the slurry for slicing is directly applied to the ingot by increasing a supply temperature of the slurry for slicing beyond the counterpart in the conventional method to reach 30° C. or above at the end of slicing and thereby the ingot is performed from being rapidly cooled.

It is to be noted that, in the temperature profile of Ts, the temperature is increased in the entire range from start of slicing to end of slicing as compared with the conventional method, and hence the temperature of the ingot is slightly increased not only in the time close to end of slicing but also in any other range as compared with the conventional method (see Ti and Ti'), but appropriately controlling, e.g., a supply temperature of the slurry for slicing at start of slicing, a degree of temperature rise in the time close to end of slicing, a temperature at end of slicing, and others enables freely performing adjustment so that a difference ΔTi between a maximum temperature Timax during slicing the ingot (which is also a temperature immediately before rapid cooling occurs) and a temperature at the end of slicing becomes small.

In particular, it is good enough to effect adjustment so that ΔTi becomes 5° C. or below. If the difference ΔTi between the maximum temperature Timax during slicing the ingot and the temperature at the end of slicing is such a small temperature difference, a change in slicing trajectory due to rapid cooling of the ingot can be further assuredly avoided.

On the other hand, since the slurry for slicing has a temperature that is nearly a room temperature (23° C. in this example) at the end of slicing like Ts' in the conventional method, the ingot whose temperature has been increased to, e.g., 36° C. during slicing is rapidly cooled in the time close to the end of slicing and has a temperature which is substantially the same as that of the slurry for slicing that is a room temperature at the end of slicing. That is, in the example depicted in FIG. 2, ΔTi' represents 13° C., and it can be understood that there is a considerable difference in a degree of rapid cooling from the present invention that can set ΔTi to 5° C. or below and the degree of rapid cooling is increased.

Figure 3:
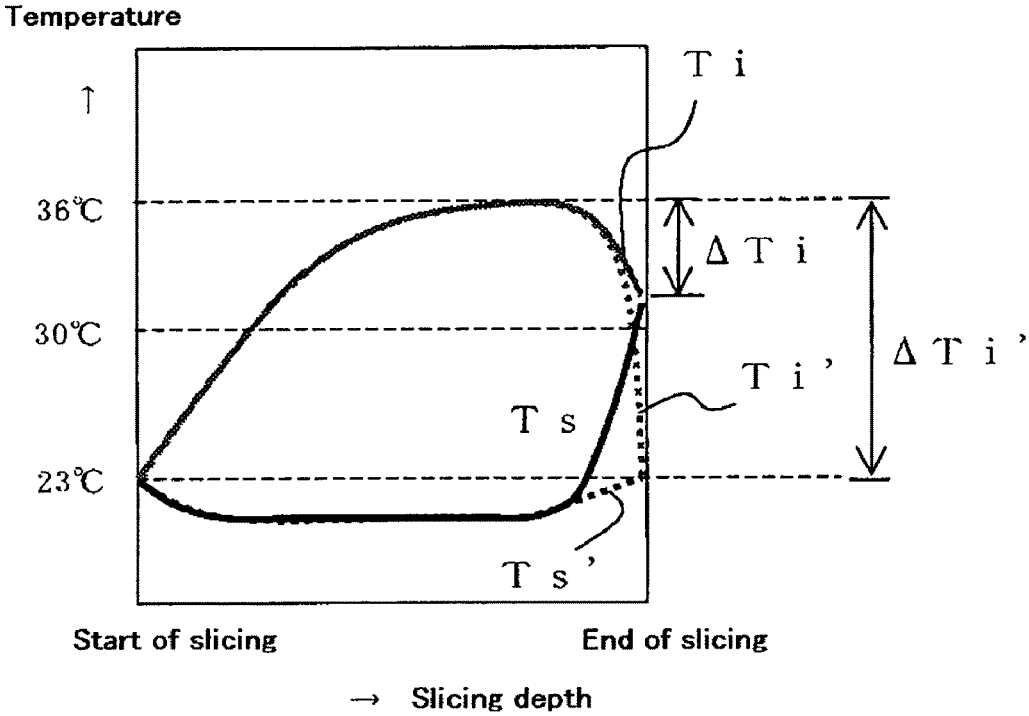
FIG. 3 is a graph showing another example of temperature profiles of the supply temperature of the slurry for slicing and the temperature of the ingot in the slicing method according to the present invention.

FIG. 3 shows another pattern of a supply temperature profile of the slurry for slicing and a temperature profile of the ingot that are different from those depicted in FIG. 2.

In a temperature profile Ts depicted in FIG. 3, a supply temperature is equal to a temperature of the ingot or below (a room temperature 23° C.) at the start of slicing, it is slightly reduced after the start of slicing, then a constant temperature is continuously maintained, this temperature is increased after a slicing depth of the ingot reaches at least ⅔ of a diameter, and it becomes 30° C. or above at the end of slicing. Such temperature control enables providing the same temperature profile as that in the conventional example except the time close to the end of slicing.

Additionally, when such a temperature profile of Ti is adopted, a temperature of the ingot at the end of slicing can be also set to 30° C. or above, thereby a degree of rapid cooling of the ingot in the time close to the end of slicing can be considerably alleviated (see ΔTi).

On the other hand, in a supply temperature profile Ts' of the slurry for slicing according to the conventional method, the same control as that of Ts depicted in FIG. 3 is carried out partway, but a temperature is not notably increased in the time close to the end of slicing, and the temperature is 23° C. and remains at a room temperature as different from the temperature of Ti that is equal to 30° C. or above at the end of slicing. That is, as explained above, the temperature profile Ti' of the ingot is precipitously reduced at the end of slicing, and ΔTi' has a value that is as large as, e.g., approximately 13° C.

Although the profiles of the supply temperature of the slurry for slicing and the temperature of the ingot according to the present invention have been explained above with reference to FIGS. 2 and 3, but the profiles of the supply temperature of the slurry for slicing and the temperature of the ingot according to the present invention are not of course restricted thereto.

It is good enough that slicing can be performed in such a manner each temperature becomes 30° C. or above at the end of slicing, as a result, a precipitous change in slicing trajectory in the time close to the end of slicing can be thereby avoided to sufficiently suppress a level of nano-topography.

It is to be noted that, e.g., expansion of the grooved rollers in an axial direction can be also additionally suppressed at this time. To avoid a precipitous change in slicing trajectory, suppressing both contraction of the ingot based on the slicing method according to the present invention and expansion of the rollers is further effective. In particular, this suppression is effective when such a supply temperature profile of the slurry for slicing as depicted in FIG. 3 is provided.

The present invention will now be explained in more detail based on examples, but the present invention is not restricted thereto.

Example 1

A wire saw shown in FIG. 1 was used to slice a silicon ingot having a diameter of 300 mm and an axial length of 250 mm into wafers based on the slicing method according to the present invention, thereby 240 sliced wafers were obtained.

A wire having a width of 160 μm was used, and a tensile force of 2.5 kgf was applied to cause the wire to travel in a reciprocating direction at an average speed of 500 m/min in a cycle of 60 s/c, thereby slicing was performed. A slurry for slicing was supplied to grooved rollers while controlling a supply temperature thereof in such a manner that the supply temperature was set to 30° C. at start of slicing, gradually reduced to 29° C. until a slicing depth of the ingot reached 50 mm, then increased from the moment that the slicing depth of the ingot reached 230 mm, and raised to 35° C. at end of slicing (see FIG. 4). That is, such a temperature profile of Ts as depicted in FIG. 2 was provided.

It is to be noted that a material obtained by mixing GC#1500 with a coolant at a weight rate of 1:1 was used as a slurry.

Moreover, thermocouples were arranged as shown in FIG. 14(B) to measure a change in temperature of the ingot during slicing.

Figure 5:
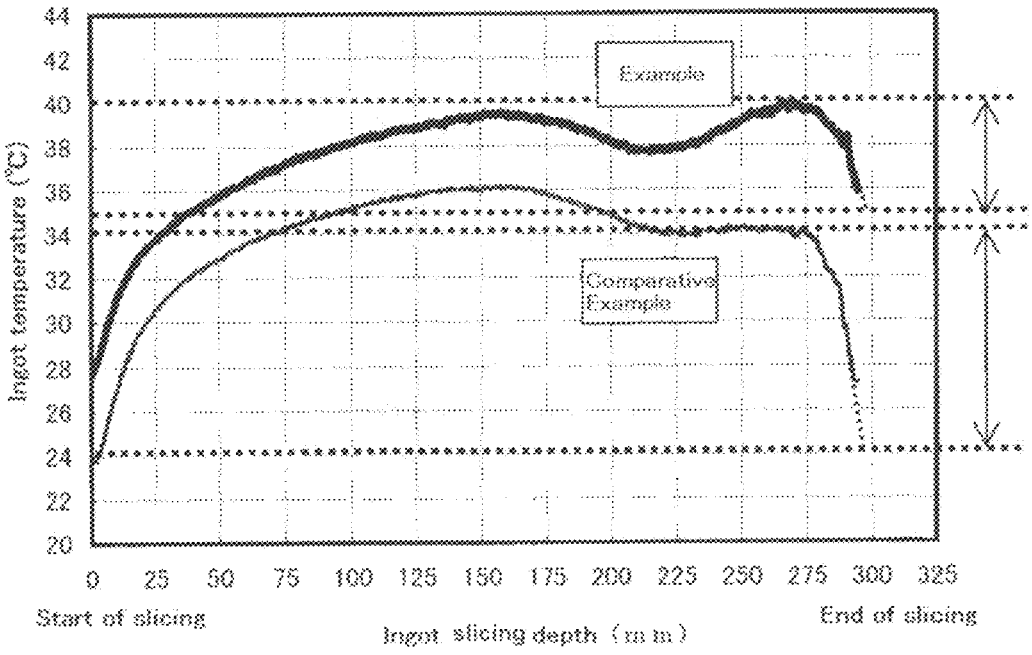
FIG. 5 is a graph showing temperature profiles of the ingot in Example 1 and Comparative Example.

FIG. 5 shows a change in temperature of the ingot at this time. FIG. 5 also shows a change in temperature of the ingot when the slurry for slicing was supplied with the same temperature slurry as that in the conventional example for comparison (a later-explained Comparative Example).

Figure 4:
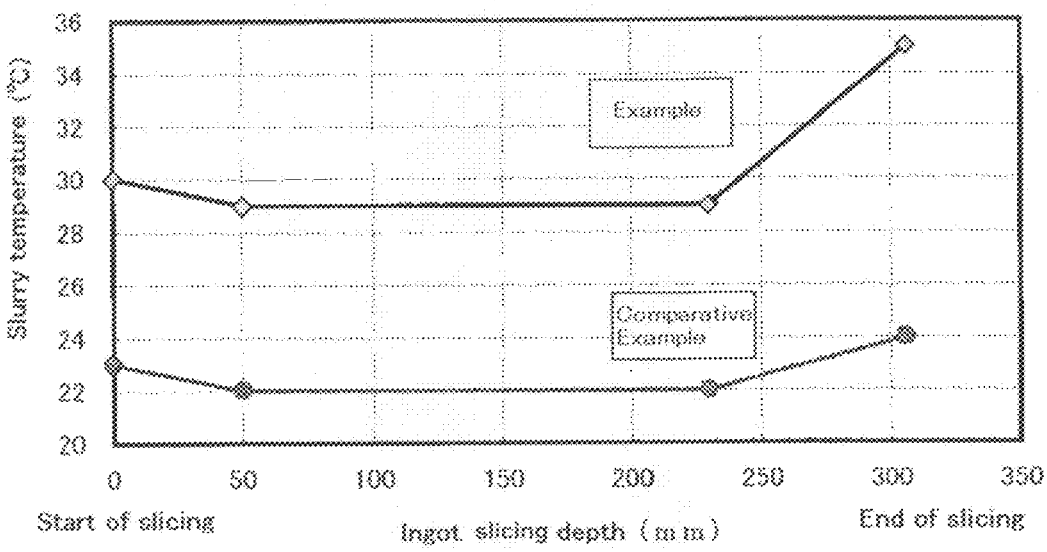
FIG. 4 is a graph showing supply temperature profiles of the slurry for slicing in Example 1 and Comparative Example.

It can be understood that controlling a supply temperature of the slurry for slicing in accordance with the temperature profile in FIG. 4 enables alleviating rapid cooling of the ingot in the time close to the end of slicing as shown in FIG. 5. More specifically, a temperature of the ingot is 40° C. when the ingot slicing depth is approximately 275 mm, and it is approximately 35° C. that is equal to a temperature of the slurry for slicing when the slicing depth is 300 mm at the end of slicing, thereby a degree of cooling can be set to 5° C. or below.

Further, pseudo nano-topographies were also examined in sliced wafers obtained by slicing a plurality of ingots-based on the same method as Example 1, and results depicted in FIG. 6(A) were obtained. FIG. 6 shows a level of each pseudo nano-topography in the time close to end of slicing with an abscissa representing a position of the ingot in an axial direction. In this manner, the level does not exceed an upper limit value (0.6 as a relative value) in any region of each ingot, an average value in each region of the ingot is 0.43 at a front end portion, 0.24 at a central portion, or 0.33 at a rear end portion, and it can be understood that the average value can be suppressed to a very small value. In this example, a reduction to a ⅔ size on average was achieved as compared with a later-explained Comparative Example.

Figure 7:
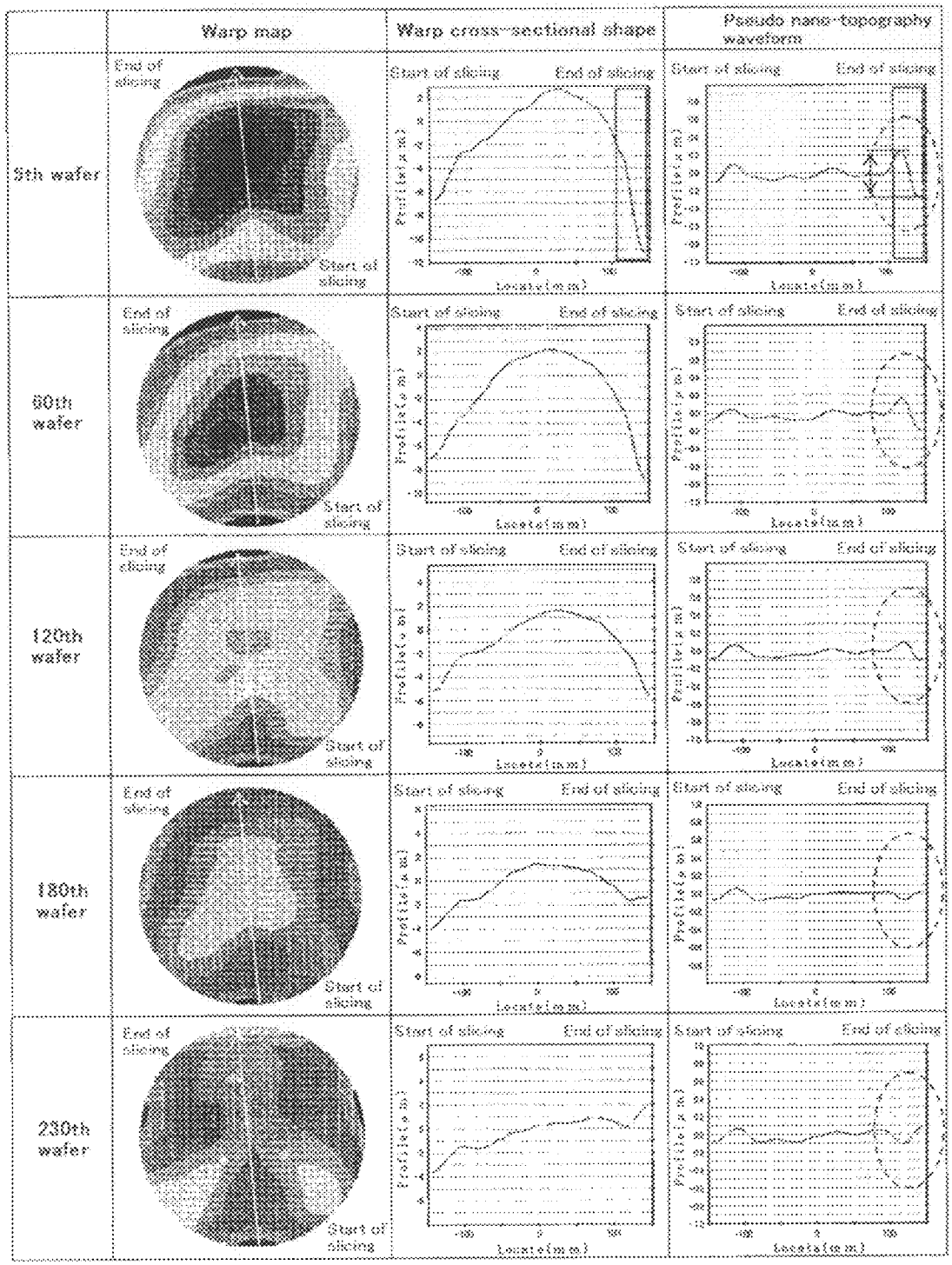
FIG. 7 is a measurement view showing an example of Warp cross-sectional shapes and pseudo nano-topographies of sliced wafers obtained by the slicing method according to the present invention.

Furthermore, Warp shapes of sliced wafers obtained by the same method as Example 1 were measured. FIG. 7 shows measurement results of sliced wafers which are fifth, 60th, 120th, 180th, and 230th from a head side of the ingot as representatives. Pseudo nano-topography waveforms are also depicted.

Paying attention to the Warp shapes in FIG. 7, a precipitous change is relatively suppressed even though the entire shape is largely changed like, e.g., the fifth wafer, and a size of its waveform is well suppressed in the range of −0.3 to 0.3 as indicated by each pseudo nano-topography waveform as compared with the examples depicted in FIG. 11(B) and FIG. 11(C) based on the conventional method. Moreover, in each of the 60th, 120th, 180th, and 230th wafers, a level of pseudo nano-topography can be reduced, it can be suppressed to the range of −0.1 to 0.1 especially in each of the 180th and 230th wafers, and it can be understood that each pseudo nano-topography has the very excellent level.

Example 2

The same silicon ingot as that in Example 1 was prepared, and the silicon ingot was sliced in the same manner as Example 1 except a supply temperature profile of a slurry for slicing.

It is to be noted that a supply temperature of the slurry for slicing was set to 23° C. at start of slicing and the slurry for slicing was supplied to grooved rollers while controlling its supply temperature so that the supply temperature was gradually reduced to 22° C. until a slicing depth of the ingot reached 50 mm, then increased from the moment that the ingot slicing depth reached 230 mm, and raised to 32° C. at end of slicing. That is, when such a temperature profile of Ts as shown in FIG. 3 was used, a temperature of the ingot was 32° C. equal to that of the slurry for slicing at end of slicing, and ΔTi can be set to 5° C. or below, thus rapid cooling at end of slicing can be suppressed.

Additionally, a level of a pseudo nano-topography was examined in the same manner as Example 1, the level did not exceed an upper limit value (0.6 as a relative value) in any region of the ingot, and an average value in each region of the ingot was 0.47 at a front end portion, 0.27 at a central portion, or 0.38 at a rear end portion, and thus, suppressing the level to a very small value was achieved.

Comparative Example the same silicon ingot as that in example 1 was prepared, and the silicon ingot was sliced in the same manner as Example 1 except a supply temperature profile of a slurry for slicing.

It is to be noted that a supply temperature of the slurry for slicing was set to 23° C. at start of slicing and the slurry for slicing was supplied to grooved rollers while controlling its supply temperature so that the supply temperature was gradually reduced to 22° C. until a slicing depth of the ingot reached 50 mm, then increased from the moment that the ingot slicing depth reached 230 mm, and raised to 24° C. at end of slicing (see FIG. 4). That is, this is the same supply temperature profile of the slurry for slicing as that in the conventional example.

Further, a temperature of the ingot was 34° C. in the time close to end of slicing (an ingot slicing depth was 275 mm) and approximately 24° C. which is equal to that of the slurry for slicing when a slicing depth was 300 mm at end of slicing as shown in FIG. 5, and hence the ingot was rapidly cooled by approximately 10° C.

It can be understood from FIG. 5 that a degree of cooling (a temperature difference) of the ingot can be reduced to ½ in Example 1 (ΔTi=5° C.) as compared with this Comparative Example even though the range of the ingot slicing depth (275 mm to 300 mm) remains unchanged.

Furthermore, FIG. 6(B) shows results of pseudo nano-topographies of sliced wafers obtained by slicing a plurality of ingots by the same method as Comparative Example. Referring to FIG. 6(B), pseudo nano-topographies exceeded an upper limit value (0.6 as a relative value) at both ends of the ingot. Moreover, an average value of the nano-topographies is 0.54 at a front end portion of the ingot, 0.33 at a central portion of the same, or 0.53 at a rear end portion of the same. As can be understood from data of Example 1 in FIG. 6(A), a level of the pseudo nano-topography (a nano-topography) can be reduced to ⅔ in each region by the slicing method according to the present invention.

Additionally, measuring Warps shapes and others of sliced wafers obtained by the same method as above Comparative Example, a precipitous change in Warp shape or pseudo nano-topography waveform was observed in a position near a slicing end portion like FIG. 11(B) or FIG. 11(C), and a level of the pseudo nano-topography was also large.

As explained above, according to the slicing method of the present invention like Example 1 or Example 2, a supply temperature of the slurry for slicing is set to 30° C. or above at end of slicing and a temperature of the ingot is also set to 30° C. or above, and thereby it is possible to suppress rapid cooling in the time close to end of slicing. And it is possible to avoid a precipitous change in slicing trajectory or Warp shape of each sliced wafer, thus considerably improve a level of nano-topography. Therefore, a yield can be increased in a device process.

It is to be noted that the present invention is not restricted to the foregoing embodiment. The embodiment is just an exemplification, and any examples that have substantially the same structure and demonstrate the same functions and effects as those in the technical concept described in claims of the present invention are included in the technical scope of the present invention.

The invention claimed is:

1. A slicing method comprising winding a wire around a plurality of grooved rollers and pressing the wire against an ingot to be sliced into wafers while supplying a slurry for slicing to the grooved rollers and causing the wire to travel, wherein:

a supply temperature of the slurry for slicing is controlled, and slicing is at least performed in such a manner that the supply temperature of the slurry for slicing is set to be higher than a temperature of the ingot at a start of slicing the ingot, then increased from the moment that a slicing depth of the ingot reaches at least ⅔ of a diameter of the ingot, and the supply temperature of the slurry for slicing and a temperature of the ingot become 30° C. or above at an end of slicing the ingot.

2. A slicing method comprising winding a wire around a plurality of grooved rollers and pressing the wire against an ingot to be sliced into wafers while supplying a slurry for slicing to the grooved rollers and causing the wire to travel, wherein:

a supply temperature of the slurry for slicing is controlled, and slicing is at least performed in such a manner that the supply temperature of the slurry for slicing is set to be equal to a temperature of the ingot or below at a start of slicing the ingot, then increased from the moment that a slicing depth of the ingot reaches at least ⅔ of a diameter of the ingot, and the supply temperature of the slurry for slicing and a temperature of the ingot become 30° C. or above at an end of slicing the ingot.

3. The slicing method according to claim 1, wherein a difference between a maximum temperature of the ingot during slicing and a temperature of the same at the end of slicing is set to 5° C. or below.

4. The slicing method according to claim 2, wherein a difference between a maximum temperature of the ingot during slicing and a temperature of the same at the end of slicing is set to 5° C. or below.

* * * * *